US010253404B2

(12) United States Patent
Long et al.

(10) Patent No.: US 10,253,404 B2
(45) Date of Patent: Apr. 9, 2019

(54) HIGH STRENGTH, HIGH FORMABILITY, AND LOW COST ALUMINUM-LITHIUM ALLOYS

(71) Applicant: KAISER ALUMINUM FABRICATED PRODUCTS, LLC, Foothill Ranch, CA (US)

(72) Inventors: Zhengdong Long, Spokane, WA (US); Philippe Lassince, Vodable (FR); Florence Andrea Baldwin, Mead, WA (US); Robert A. Matuska, Heath, OH (US); Yansheng Liu, Spokane, WA (US); Roy Austin Nash, Spokane, WA (US); Jason Nicholas Scheuring, Spokane, WA (US); Gary D. Holmesmith, Medical Lake, WA (US)

(73) Assignee: Kaiser Aluminum Fabricated Products, LLC, Foothill Ranch, CA (US)

( * ) Notice: Subject to any disclaimer, the term of this patent is extended or adjusted under 35 U.S.C. 154(b) by 419 days.

(21) Appl. No.: 14/523,931

(22) Filed: Oct. 26, 2014

(65) Prior Publication Data

US 2016/0115576 A1 Apr. 28, 2016

(51) Int. Cl.
*C22C 21/12* (2006.01)
*C22F 1/057* (2006.01)
(Continued)

(52) U.S. Cl.
CPC ..... *C22F 1/057* (2013.01); *C22C 21/12* (2013.01); *C22C 21/14* (2013.01); *C22C 21/16* (2013.01); *C22C 21/18* (2013.01); *C22F 1/002* (2013.01)

(58) Field of Classification Search
CPC ..... C22C 21/00–21/18; C22F 1/04–1/057
See application file for complete search history.

(56) References Cited

U.S. PATENT DOCUMENTS 4,594,222 A 6/1986 Heck et al.
5,032,359 A 7/1991 Pickens et al.
(Continued)

FOREIGN PATENT DOCUMENTS

CN 101967588 A 2/2011
CN 102021457 A 4/2011
WO 9504837 A1 2/1995

OTHER PUBLICATIONS

D.J. Chakrabarti, et al.; Through Thickness Property Variations in 7050 Plate; Material Science Forum; vols. 217-222 (1996); pp. 1085-1090.

(Continued)

*Primary Examiner* — Lois L Zheng
(74) *Attorney, Agent, or Firm* — Yancy IP Law, PLLC

(57) ABSTRACT

A high strength, high formability and low cost 2xxx aluminum-lithium alloy is disclosed. The aluminum-lithium alloy is capable of being formed into wrought products with a thickness of from about 0.01" to about 0.249". Aluminum-lithium alloys of the invention generally comprise from about 3.5 to 4.5 wt. % Cu, 0.8 to 1.6 wt. % Li, 0.6 to 1.5 wt. % Mg, from 0.03 to 0.6 wt. % of at least one grain structure control element selected from the group consisting of Zr, Sc, Cr, V, Hf, and other rare earth elements, and up to 1.0 wt. % Zn, up to 1.0 wt. % Mn, up to 0.12 wt. % Si, up to 0.15 wt. % Fe, up to 0.15 wt. % Ti, up to 0.05 wt. % of any other element, with the total of these other elements not exceeding 0.15 wt. %, and the balance being aluminum. Ag should not be more than 0.5 wt. % and is preferably not intentionally added. Mg is at least equal or higher than Zn in weight percent in the invented alloy. Further provided are methods for manufacturing wrought products including the aluminum-lithium alloys of the present invention.

27 Claims, 4 Drawing Sheets

(51) Int. Cl.

| | |
|---|---|
| ***C22C 21/16*** | (2006.01) |
| ***C22C 21/14*** | (2006.01) |
| ***C22C 21/18*** | (2006.01) |
| ***C22F 1/00*** | (2006.01) |

(56) References Cited

U.S. PATENT DOCUMENTS

| | | | |
|---|---|---|---|
| 5,213,639 | A | 5/1993 | Colvin et al. |
| 7,229,509 | B2 | 6/2007 | Cho |
| 7,438,772 | B2 | 10/2008 | Rioja et al. |
| 7,744,704 | B2 | 6/2010 | Bes et al. |
| 8,118,950 | B2 | 2/2012 | Colvin et al. |
| 2009/0142222 | A1 | 6/2009 | Colvin et al. |
| 2010/0180992 | A1 | 7/2010 | Giummarra |
| 2011/0030856 | A1 | 2/2011 | Warner |
| 2011/0209801 | A2 | 9/2011 | Warner et al. |
| 2013/0302206 | A1 | 11/2013 | Boselli et al. |
| 2014/0050936 | A1 | 2/2014 | Boselli et al. |

OTHER PUBLICATIONS

O. Engler, et al.; A Study of Through-Thickness Texture Gradients in Rolled Sheets; Metallurgical and Materials Transaction A; vol. 31A, Sep. 2000; pp. 2299-2315.

HIGH STRENGTH, HIGH FORMABILITY, AND LOW COST ALUMINUM-LITHIUM ALLOYS

BACKGROUND OF THE INVENTION

1. Field of the Invention

This present invention generally relates to Aluminum-Copper-Lithium-Magnesium based alloy products.

2. Description of Related Art

In order to aggressively reduce aircraft weight for better fuel efficiency, low density aluminum-lithium alloys are being assertively pursued by airframe manufacturers and aluminum material manufacturers.

When it comes to sheet products used in aircraft applications, aircraft designers generally use either "medium strength—high damage tolerance" alloys like AA2024 alloy and its recent derivatives like 2524 (see for example U.S. Pat. No. 5,213,639), or "high strength—medium damage tolerance" alloys like AA7075 alloy.

For both types of alloys (i.e. AA2024 type alloys or AA7075 type alloys), there are additional requirements to be fulfilled in order to be used by the aircraft industry. For instance, better formability is required in order to produce the complex parts needed on an aircraft and a better corrosion resistance than incumbent alloys is desired for lower aircraft maintenance and operation cost.

If there has been a considerable amount of works related to low density, Al—Li based alloys alternatives to AA2024 type alloys (i.e. medium strength—high damage tolerance), limited Al—Li based product has been developed to provide aircraft designers with better alternatives than currently used high strength 7075 sheet.

The strength of Al—Li sheet is critical for aerospace applications. The higher strength allows less total weight component design for better fuel efficiency. As a reference, the yield strength of commonly used 7075-T6 aluminum alloy at about 0.05" thickness sheet is 68 ksi based on "Aluminum Standards and Data 2013" published by The Aluminum Association. Most of the current Al—Li sheet alloys have very low strength compared with 7xxx sheet.

It is also well known that it is an extreme metallurgical and technical challenge to produce aluminum-lithium (Al—Li) product, especially very thin sheet products, in which the material strength, formability, fracture toughness, fatigue resistance, and corrosion resistance are required simultaneously.

Metallurgically, the desired microstructure and texture, which strongly affect the final product properties, are much more difficult to control for sheet, especially thin sheet, Al—Li products. The microstructure and texture are strongly affected by chemical composition of the alloy and most of the manufacturing steps, i.e. homogenization, hot and cold rolling, annealing, solution heat treatment, and stretching. Al—Li sheet, especially thin sheet, is much more difficult to manufacture than conventional alloy: thin Al—Li sheets are more sensitive to rolling cracking, surface oxidation, and distortion. Due to these limitations, there is a small processing window that can be used to optimize the desired microstructure and texture. Therefore, this is a significant challenge to design an aluminum-lithium sheet alloy which achieves the desired combination of properties (strength, formability, cost, with good damage tolerance and corrosion resistance). These fabrication technical challenges restrict a lot the production of high strength thin sheet Al—Li product.

As a consequence, there is only one Al—Li alloy, i.e. AA2090, registered for sheet products with a thickness less than 0.063", and only one additional alloy, i.e. AA2198, registered for sheet products with a thickness less than 0.125", and only two additional alloys, i.e. AA2195 and AA2199, registered for sheet/plate products with a thickness less than 0.5", based on the most recently (2011) published "Registration Record Series—Tempers for Aluminum and Aluminum Alloys Production" by The Aluminum Association.

These metallurgical and technical challenges for producing high strength thin sheet products are also reflected in the patents and patent applications. In fact, a significant amount of patents or patent applications are mostly related to plate products (>0.5"), but only a few to sheet products.

The cost of Al—Li alloy product is another concern. Silver (Ag) element is added to many new generation Al—Li alloys in order to improve the final product properties, adding significant alloy costs. Among those four registered Al—Li alloys sheet products mentioned previously, two of them (AA2198 and AA2195) are Ag containing alloys.

U.S. Pat. No. 7,744,704 discloses an aluminum-lithium alloy for aircraft fuselage sheet or light-gauge plate applications. This patent is the basis for the registered AA2198 Al—Li sheet alloy. This alloy comprises 0.1 to 0.8 wt. % Ag, so it is not considered to be a low cost alloy. Furthermore it has a relatively low strength compared to 7075 T6 sheets.

U.S. Pat. No. 7,438,772 discloses an aluminum-copper-magnesium alloy having ancillary additions of lithium. This patent is the basis for registered AA2060 Al—Li alloy. The claimed level for lithium is only from 0.01 to 0.8 wt. %; because of this limited addition of lithium, this is not considered to be really a "low-density" alloy.

U.S. Pat. No. 8,118,950 discloses improved aluminum-copper-lithium alloys. This patent is the basis for registered AA2055 Al—Li alloy. This alloy comprises 0.3 to 0.7 wt. % Ag, so it is not considered to be a low cost alloy. As provided in the patent, the alloy is used for high-strength extrusions.

U.S. Pat. No. 7,229,509 discloses an alloy with a broad chemical composition range, and including 0.2 to 0.8 wt. % Ag, so it is not considered to be a low-cost alloy. This patent is the basis for registered AA2050 Al—Li plate alloy. As described in the paper of "Aluminum-Copper-Lithium Alloy 2050 Developed for Medium to Thick Plate [Lequeu 2010]", AA2050 is designed for Al—Li plate products from 12.7 mm (0.5") to 127 mm (5'). Similar to patent U.S. Pat. No. 7,229,509, patent application of "US20110209801 A2" includes 0.15 to 0.35 wt. % Ag. In addition, this application specifically claims that the alloy is suitable for plate in thickness range of 30 mm (1.2") to 100 mm (3.9").

Other patent applications that includes Ag and are also used for thick plates are "US 2009/0142222 A1" and "US 2013/0302206".

U.S. Pat. No. 5,032,359 discloses an alloy including 0.05 to 1.2 wt. % Ag, so it is not considered to be a low-cost alloy. The main advantage of this alloy is to have high strength, ductility, excellent weldability, and natural aging response.

Patent application of "US 2014/0050936 A1" discloses an Al—Li alloy product containing 3.00 to 3.80 wt. % Cu, 0.05 to 0.35 wt. % Mg, and 0.975 to 1.385 wt. % Li. This is basically an Al—Li version of "high damage tolerance—medium strength" application alloy, with strength not matching the AA7075 performance.

In general, the current related prior art teaches that (1) there is a strong need for high strength, low density, high formability, low cost, together with good damage tolerance and corrosion properties, Al—Li alloys capable of producing thin sheet products; (2) it is an extreme metallurgical and technical challenge to produce such products; (3) the very expensive Ag is often added for better metallurgical quality, but this addition significantly increases the Al—Li product cost.

BRIEF SUMMARY OF THE INVENTION

The present invention provides a high strength, high formability and low cost aluminum-lithium alloy, suitable for use in making transportation components, such as aerospace structural components. The aluminum-lithium alloy of the present invention comprises from about 3.5 to 4.5 wt. % Cu, 0.8 to 1.6 wt. % Li, 0.6 to 1.5 wt. % Mg, one or more grain structure control elements selected from the group consisting Zr, Sc, Cr, V, Hf, and other rare earth elements, and up to 1.0 wt. % Zn, up to 1.0 wt. % Mn, up to 0.12 wt. % Si, up to 0.15 wt. % Fe, up to 0.15 wt. % Ti, up to 0.15 wt. % of incidental element, with the total of these incidental elements not exceeding 0.35 wt. %, the balance being aluminum. The level of Mg is at least equal or higher than Zn in weight percent in the aluminum-lithium alloy. The amount of Ag is preferably less than 0.5 wt. %.

Preferably, the aluminum-lithium alloy of the present invention is a sheet, extrusion or forged wrought product having a thickness of 0.01-0.249 inch, more preferably 0.01-0.125 inch thickness. It has been surprisingly discovered that the aluminum-lithium alloy of the present invention having no Ag, or very low amounts of Ag, and high Mg content is capable of producing 0.01 to 0.249 inch thickness sheet products with high strength, low density, low cost, excellent formability, and good damage tolerance properties and corrosion resistance.

Another aspect of the present invention is a method to manufacture aluminum-lithium alloys of the present invention.

BRIEF DESCRIPTION OF THE DRAWINGS

The features and advantages of the present invention will become apparent from the following detailed description of a preferred embodiment thereof, taken in conjunction with the accompanying drawings, in which.

DETAILED DESCRIPTION OF THE INVENTION

Figure 1:
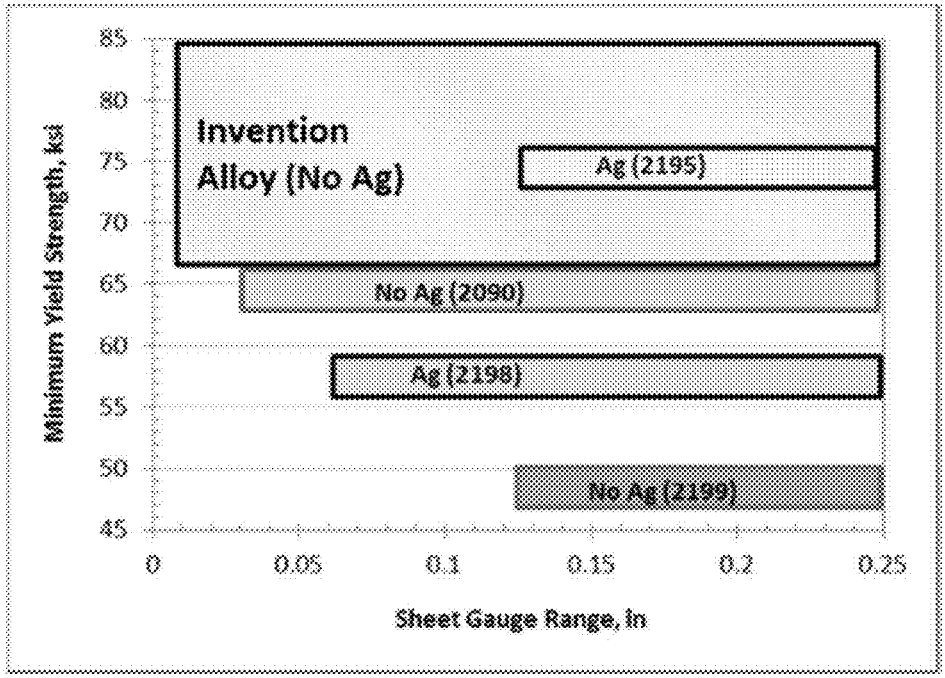
FIG. 1 is a graph showing Yield Strength vs Sheet Gauge for the aluminum-lithium alloy of the present invention and registered alloys.

The present invention is directed to aluminum-lithium alloys, specifically—aluminum-copper-lithium-magnesium alloys. The aluminum-lithium alloy of the present invention comprises from about 3.5 to about 4.5 wt. % Cu, about 0.8 to about 1.6 wt. % Li, about 0.6 to about 1.5 wt. % Mg, from about 0.03 to about 0.6 wt. % of at least one grain structure control element selected from the group consisting of Zr, Sc, Cr, V, Hf, and other rare earth elements, and optionally up to about 1.0 wt. % Zn, optionally up to about 1.0 wt. % Mn, up to about 0.12 wt. % Si, up to about 0.15 wt. % Fe, up to about 0.15 wt. % Ti, up to about 0.15 wt. % incidental elements, with the total of these incidental elements not exceeding 0.35 wt. %, the balance being aluminum. The aluminum-lithium alloy of the present invention should not have more than about 0.5 wt. % Ag. Alternatively, it is preferred that Ag is not intentionally added in the aluminum-lithium alloy. As such, the aluminum-lithium alloy may include alternate embodiments having less than about 0.2 wt. % Ag, less than about 0.1 wt. % Ag, less than about 0.05 wt. % Ag, or less than about 0.01 wt. % Ag. In a preferred embodiment, the aluminum-lithium alloy has a Mg content that is at least equal to or higher than Zn in weight percent.

In an alternate embodiment, the aluminum-lithium alloy comprises about 3.6 to about 4.2 wt. % Cu, about 0.9 to about 1.5 wt. % Li, about 0.8 to about 1.2 wt. % Li, about at least 0.05 wt. % of at least one grain structure control element selected from the group consisting of Zr, Sc, Cr, V, Hf, and other rare earth elements, a maximum of about 0.05 wt. % Si, a maximum of about 0.08 wt. % Fe. Such embodiment of the aluminum-lithium alloy would also have a Mg content that is at least equal to or higher than Zn in weight percent. Additionally, the aluminum-lithium alloy may include less than about 0.2 wt. % Ag, less than about 0.1 wt. % Ag, less than about 0.05 wt. % Ag, or less than about 0.01 wt. % Ag. In a preferred embodiment, no Ag is intentionally added to the aluminum-lithium alloy.

The aluminum-lithium alloy of the present invention can be used to produce wrought products, preferably, having a thickness range of 0.01-0.249 inch, more preferably in the thickness range of 0.01-0.125 inch. In addition to low density and low cost, the aluminum-lithium alloys of the present invention are wrought products having high strength, excellent formability, good damage tolerance and corrosion properties.

Such products are suitable for the use in many structural applications, especially for aerospace structural components such as frames, stringers, and fuselages. The aluminum-lithium alloy of the present invention can be used in a number of manufacturing processes in the fabrication of sheet metal components. Common methods are roll forming, stretch forming, hammer drop forming, stamping, draw forming, and hydroforming. Example components that can be made from these forming methods, but not limited to, are fuselage frames, fuselage stringers, contoured fuselage skins, constant cross-section skins, electrical wire harnesses clips, brackets for cable used in control systems, attachment points for interior components to primary structures such as fuselage frames, shear ties for attaching fuselage frames to fuselage skins, shear ties for attaching wing ribs to wing skins, wing ribs, clips to attach wing ribs to wing spars, empennage skins, empennage ribs, nacelle skins, engine leading edge inlet skins, pressure bulkhead skins, pylon skins, bracketry for attaching avionics to structural components, bracketry for attaching passenger oxygen systems, avionics enclosures, shelving for avionics components, etc.

As demonstrated in FIG. 1, the aluminum-lithium alloy of the present invention has uniquely high strength and low cost and also is capable of producing very thin sheet products compared against other known aluminum-lithium alloys.

The compositional ranges of the main alloying elements (Copper, Lithium, Magnesium) of the aluminum-lithium alloys of the present invention are listed in Table 1:

TABLE 1

Copper, Lithium and Magnesium Compositional Ranges

| | Cu | Li | Mg |
|---|---|---|---|
| Typical | 3.5-4.5 | 0.8-1.6 | 0.6-1.5 |
| Preferred | 3.6-4.2 | 0.9-1.5 | 0.8-1.2 |

Copper is added to the aluminum-lithium alloy of the present invention in the range of 3.5 to 4.5 wt. %, mainly to enhance the strength and also to improve the combination of strength, formability and fracture toughness. An excessive amount of Cu, particularly in the set range of the aluminum-lithium alloy of the present invention, could result in unfavorable intermetallic particles which can negatively affect material properties such as ductility, formability, and fracture toughness. The interaction of Cu with other elements such as Li and Mg also should be considered. In one preferred embodiment Cu is in the range of 3.6 to 4.2 wt. %. It is understood that within the range of 3.5 to 4.5 wt. % Cu, the upper or lower limit for the amount of Cu may be selected from 3.5, 3.6, 3.7, 3.8, 3.9, 4.0, 4.1, 4.2, 4.3, 4.4, and 4.5 wt. % Cu.

Lithium is added to the aluminum-lithium alloy of the present invention in the range of 0.8 to 1.6 wt. %. The primary benefit for adding Li element is to reduce density and increase elastic modulus. Combined with other elements such as Cu, Li is also critical to improve the strength, damage tolerance and corrosion performance. A too high Li content, however, can negatively impact fracture toughness, anisotropy of tensile properties, and formability properties. In one preferred embodiment, Li is in the range of 0.9 to 1.5 wt. %. It is understood that within the range of 0.8 to 1.6 wt. % Li, the upper or lower limit for the amount of Li may be selected from 0.8, 0.9, 1.0, 1.1, 1.2, 1.3, 1.4, 1.5, and 1.6 wt. % Li.

Mg is added to the aluminum-lithium alloy of the present invention in the range of 0.6 to 1.5 wt. %. The primary purpose of adding Mg is to enhance the strength with the secondary purpose of reducing density slightly. However, a too high amount of Mg can reduce Li solubility in the matrix, therefore significantly and negatively impacts the aging kinetic for higher strength. In one preferred embodiment Mg is in the range of 0.8 to 1.2 wt. %. It is understood that within the range of 0.6 to 1.5 wt. % Mg, the upper or lower limit for the amount of Mg may be selected from 0.6, 0.7, 0.8, 0.9, 1.0, 1.1, 1.2, 1.3, 1.4 and 1.5 wt. % Mg.

The addition of low level of Zn in the aluminum-lithium alloy of the present invention aims at improving the corrosion resistance. In one embodiment, the addition of Zn is optional and can be up to 1.0 wt. %. It is understood that the upper limit for the amount of Zn may be selected from 0.1, 0.2, 0.3, 0.4, 0.5, 0.6, 0.7, 0.8, 0.9 and 1.0 wt. % Zn. In another embodiment, the Mg/Zn ratio should be higher than 1.0.

In one embodiment, Ag is not intentionally added in the aluminum-lithium alloy of the present invention. Ag may exist in the alloy as a result of non-intentionally added element. In this case, the Ag should not be more than 0.5 wt. %. The aluminum-lithium alloy may include alternate embodiments having less than 0.2 wt. % Ag, less than 0.1 wt. % Ag, or less than 0.05 wt. % Ag. Ag is believed to improve the final product properties and therefore is included in many aluminum-lithium alloys as well as in many patents and patent applications. However, Ag significantly increases the cost of the alloys. In the preferred embodiment of the aluminum-lithium alloy of the present invention, Ag is not intentionally included in order to reduce the cost. It is surprising to find that the aluminum-lithium alloy of the present invention, without the addition of Ag for providing low cost, can be used to produce high strength, high formability, excellent corrosion resistance, and good damage tolerance performance sheet products suitable for structural applications particularly aerospace structural applications.

In one embodiment, Mn may be optionally included up to 1.0 wt. %. In one embodiment, Mn level is at least 0.1 wt. %. It is understood that the upper or lower limit for the amount of Mn may be selected from 0.1, 0.2, 0.3, 0.4, 0.5, 0.6, 0.7, 0.8, 0.9 and 1.0 wt. % Mn. Mn may help improve the grain structures for better mechanical anisotropy and formability.

Ti can be added up to 0.15 wt. %. The purpose of adding Ti is mainly for grain refining. It is understood that the upper limit for the amount of Ti may be selected from 0.01, 0.02, 0.05, 0.06, 0.07, 0.08, 0.09, 0.10, 0.11, 0.12, 0.13, 0.14 and 0.15 wt. % Ti.

In addition to aluminum, copper, lithium, magnesium, optionally zinc, optionally manganese, and titanium, the aluminum-lithium alloy of the present invention can contain at least one of the grain structure control elements selected from the group consisting of Zr, Sc, Cr, V, Hf, and other rare earth elements in a total amount of up to 1.0 wt. %. In one embodiment, such grain structure control element has to be at least 0.05 wt. %. It is understood that the upper or lower limit for the total amount of grain structure control elements may be selected from 0.05, 0.1, 0.2, 0.3, 0.4, 0.5, 0.6, 0.7, 0.8, 0.9, 1.0 wt. %.

Si and Fe may be present in the aluminum-lithium alloy of the present invention as impurities but are not intentionally added. When present their content must be up to about 0.12 wt. % for Si, and up to 0.15 wt. % for Fe. Si, preferably <0.05 wt. % Si. In one embodiment, the aluminum-lithium alloy of the present invention includes a maximum content of about 0.05 wt. % for Si, and 0.08 wt. % for Fe.

The aluminum-lithium alloy of the present invention may also include low level of "incidental elements" that are not included intentionally. The "incidental elements" means any other elements except above described Al, Cu, Li, Mg, Zn, Mn, Ag, Fe, Si, Ti, Zr, Sc, Cr, V, Hf and other rare earth elements.

The high strength, low cost Al—Li alloy of the present invention may be used to produce wrought products. In one embodiment, the aluminum-lithium alloy of the present invention is capable of producing rolled products, preferably, a sheet or coil product in the thickness range of 0.01-0.249 inch, more preferably in the range of 0.01-0.125 inch.

The rolled products may be manufactured using known processes such as casting, homogenization, hot rolling, optionally cold rolling, solution heat treatment and quench, optionally stretching and levelling, and ageing treatments. The ingot may be cast by traditional direct chill (DC) casting method. The ingot may be homogenized at temperatures from 454 to 549° C. (850 to 1020° F.), preferably from 482 to 543° C. (900 to 1010° F.), and more preferably from 496 to 538° C. (925 to 1000° F.). The hot rolling temperature may be from 343 to 499° C. (650 to 930° F.), preferably from 357 to 482° C. (675 to 900° F.), and more preferably from 371 to 466° C. (700 to 870° F.). The optional cold rolling may be needed particularly for the thinnest gauges. The cold work reduction can be from 20% to 95%, preferably from 40% to 90%. The products may be solution heat treated at temperature range from 454 to 543° C. (850 to 1010° F.), preferably from 482 to 538° C. (900 to 1000° F.), and more preferably from 493 to 532° C. (920 to 990° F.). The wrought products are cold water quenched to room temperature and may be optionally stretched or cold worked up to 15%, preferably from 2 to 8%. The quenched product may be subjected to any aging practices known by those skilled in the art including, but not limited to, one-step aging practices that produce a final desirable temper, such as T8 temper, for better combination of strength, fracture toughness, and corrosion resistance which are highly desirable for aerospace members. The aging temperature can be in the range of 121 to 205° C. (250 to 400° F.) preferably from 135 to 193° C. (275 to 380° F.), and more preferably from 149 to 182° C. (300 to 360° F.) and the aging time can be in the range of 2 to 60 hours, preferably from 10 to 48 hours.

Many aerospace parts, such as frames, need to be formed to the designed geometry for final applications. Therefore, the formability is also a critical consideration along with static and dynamic material properties. The formability is normally evaluated by simple bending test method and/or more sophisticated Forming Limit Diagram (FLD) method. The formability of T3 temper sheet is primarily focused for aluminum-lithium alloy of the present invention. For high strength 7xxx and 2xxx alloy sheet, the O temper is commonly provided from aluminum product manufacturer (aluminum mill) to airframe manufacturer. The O temper sheet is processed in different ways such as forming, solutionizing, cold water quenching, and aging. The T3 temper sheet provided has a significant cost advantage since it eliminates the process of solutionizing and cold water quenching process steps at the airframer.

Rolled products including the aluminum-lithium alloy of the present invention having a maximum thickness of about 0.249" may exhibit in a solution heat-treated, quenched, stretched and artificially aged condition a minimum longitudinal yield strength of 68 ksi. Alternatively, rolled products including the aluminum-lithium alloy of the present invention having a maximum thickness of about 0.249" may exhibit in a solution heat-treated, quenched, stretched and artificially aged condition a minimum longitudinal yield strength of 74 ksi. Furthermore, rolled products including the aluminum-lithium alloy of the present invention having a maximum thickness of about 0.249" may exhibit in a solution heat-treated, quenched, stretched and artificially aged condition a minimum bending radius of 1.88*t in the longitudinal direction. Additionally, rolled products including the aluminum-lithium alloy of the present invention having a maximum thickness of about 0.249" may exhibit in a solution heat-treated, quenched, stretched and artificially aged condition a minimum longitudinal yield strength of 68 ksi or 74 ksi, and a minimum bending radius of 1.88*t in the longitudinal direction.

Rolled products including the aluminum-lithium alloy of the present invention having a maximum thickness of about 0.125" may exhibit in a solution heat-treated, quenched, stretched and artificially aged condition a minimum longitudinal yield strength of 68 ksi. Alternatively, rolled products including the aluminum-lithium alloy of the present invention having a maximum thickness of about 0.125" may exhibit in a solution heat-treated, quenched, stretched and artificially aged condition a minimum longitudinal yield strength of 74 ksi. Furthermore, rolled products including the aluminum-lithium alloy of the present invention having a maximum thickness of about 0.125" may exhibit in a solution heat-treated, quenched, stretched and artificially aged condition a minimum bending radius of 1.88*t in the longitudinal direction. Additionally, rolled products including the aluminum-lithium alloy of the present invention having a maximum thickness of about 0.125" may exhibit in a solution heat-treated, quenched, stretched and artificially aged condition a minimum longitudinal yield strength of 68 ksi or 74 ksi, and a minimum bending radius of 1.88*t in the longitudinal direction.

The following examples illustrate various aspects of the invention and are not intended to limit the scope of the invention.

Example 1: Book Mold Ingot Based Product Study

Eleven book mold ingots with the approximate dimension of 1.25"×6"×12" were cast and processed into 0.05" sheet products. Table 2 gives the chemical compositions of these 11 book mold ingots. Among these 11 chemistries, #5 is not in the range of the inventive chemical composition due to very low Cu content. #6 to #11 ingots have about 0.3 wt. % Ag, therefore, are not in the inventive chemical composition range.

TABLE 2

| Sample ID | Invention alloy? | Alloy Compositions, wt. % | | | | | |
|---|---|---|---|---|---|---|---|
| | | Cu | Li | Mg | Ag | Zr | Zn |
| 1 | Invention | 3.7 | 1.2 | 1.0 | | 0.07 | 0.38 |
| 2 | Invention | 3.8 | 1.0 | 1.3 | | 0.07 | 0.36 |
| 3 | Invention | 4.0 | 1.3 | 0.8 | | 0.07 | 0.39 |
| 4 | Invention | 4.0 | 1.0 | 0.8 | | 0.05 | 0.38 |
| 5 | Not Invention | 3.3 | 1.0 | 1.3 | | 0.07 | 0.36 |
| 6 | Not Invention | 3.6 | 1.1 | 1.0 | 0.29 | 0.08 | 0.00 |
| 7 | Not Invention | 3.9 | 1.3 | 1.1 | 0.28 | 0.07 | 0.00 |
| 8 | Not Invention | 4.1 | 1.4 | 1.4 | 0.29 | 0.08 | 0.00 |
| 9 | Not Invention | 4.1 | 1.4 | 0.8 | 0.28 | 0.07 | 0.00 |
| 10 | Not Invention | 4.2 | 1.1 | 0.8 | 0.29 | 0.06 | 0.00 |
| 11 | Not Invention | 4.2 | 1.1 | 1.3 | 0.29 | 0.08 | 0.00 |

Book mold ingots were surface scalped, homogenized, hot rolled, cold rolled, solution heat treated, quenched, stretched, and aged to final T8 temper 0.05" thickness sheets.

The ingots were homogenized at temperatures from 496 to 538° C. (925 to 1000° F.). The hot rolling temperatures were in the range of 399 to 466° C. (750 to 870° F.). The ingots were hot rolled at multiple passes into 0.06 to 0.20" thickness sheets. Although the cold rolling is optional, all the example book mold sheets were further cold rolled to 0.05" thickness. The cold rolled sheets were solution heat treated at a temperature range from 493 to 532° C. (920 to 990° F.). The sheets were cold water quenched to room temperature. Although the stretching or cold working is optional, all the example sheets were stretched at about 2 to 6%. The stretched sheets were aged to T8 temper in the temperature range of 166° C. (330° F.) for 24 hours. The formability of T3 temper sheets was evaluated, and tensile properties were evaluated for T8 temper sheets.

Table 3 gives the sheet tensile properties in the T8 (aged) temper. The 0.2% offset yield strength (TYS) and ultimate tensile strength (UTS) along rolling direction (L) were measured under ASTM B557 specification. The #5 chemistry, which is not within the inventive chemistry range, has much lower strength due to low Cu content. Samples #6 to #11, which are the non-invention, Ag-containing alloys, have high strengths, as expected. However it is surprising to see that alloys #1 to #4, the inventive, non Ag-containing alloys, have also high strength, very close to the Ag-containing alloys.

Table 3 includes the minimum required in industry AMS specifications for 7075 T62 sheets and 2024 T3 sheets. Invention alloys are at the level of 7075 T62, and much higher than 2024 T3 minimums.

Table 3 also includes the specific yield strength, i.e. strength divided by density: the inventive alloys are much higher than 7075 T62 incumbent alloy.

TABLE 3

| | | T8 Temper Sheet Tensile Properties | | | |
|---|---|---|---|---|---|
| Sample ID | Invention alloy? | L UTS, ksi | L TYS, ksi | Density, lbs/in 3 | Specific L TYS, ksi/(lb/in 3) |
| 1 | Invention | 77.0 | 74.6 | 0.097 | 771 |
| 2 | Invention | 77.6 | 74.8 | 0.097 | 769 |
| 3 | Invention | 80.7 | 78.9 | 0.097 | 816 |
| 4 | Invention | 77.5 | 74.7 | 0.098 | 766 |
| 5 | Not Invention | 73.4 | 70.9 | 0.097 | 733 |
| 6 | Not Invention | 76.7 | 74.6 | 0.097 | 768 |
| 7 | Not Invention | 78.4 | 75.7 | 0.097 | 784 |
| 8 | Not Invention | 80.2 | 77.4 | 0.096 | 804 |
| 9 | Not Invention | 83.3 | 80.3 | 0.096 | 833 |
| 10 | Not Invention | 84.3 | 81.6 | 0.097 | 837 |
| 11 | Not Invention | 80.4 | 78.3 | 0.097 | 805 |
| 2024-T3 Specification (AMS4037) | | 63.0 | 42.0 | 0.101 | 415 |
| 7075-T62 Specification (AMS4045) | | 78.0 | 69.0 | 0.102 | 676 |

The T3 temper sheet bending performance was also evaluated based on ASTM 290-09. One end of the sheet specimen along with the bend support die was held together in a vise. A force was applied on the other end of sheet to bend against the radius of a support die to 180°. After bending, the surface of the specimen was examined to determine if there were cracks. The bend ratio R/t, i.e. support die radius (R) to sheet thickness (t), is normally used to evaluate bending performance. The lower the bend ratio indicates the better the bending performance.

Table 4 gives the bending performance of each alloy sheet. "Crack" in the table indicates there were notable cracks after the bending test. As can be seen, the minimum bend ratio before cracking is 1.6*t to 1.88*t, which is a very good performance: for example, on the widely used 2024 T3 sheets, the minimum bend ratio in the industry specification AMS 4037 is 2.5*t. There is no noticeable difference between Ag-containing and the low cost non-Ag containing inventive alloys.

TABLE 4

| | | Bended sample surface cracking | | | |
|---|---|---|---|---|---|
| Sample ID | Invention alloy? | 1.25t | 1.6t | 1.88t | 2.4t |
| 1 | Invention | Crack | No Crack | No Crack | No Crack |
| 2 | Invention | Crack | No Crack | No Crack | No Crack |
| 3 | Invention | Crack | Crack | No Crack | No Crack |
| 4 | Invention | Crack | No Crack | No Crack | No Crack |
| 5 | Not Invention | Crack | No Crack | No Crack | No Crack |
| 6 | Not Invention | Crack | No Crack | No Crack | No Crack |
| 7 | Not Invention | Crack | Crack | No Crack | No Crack |
| 8 | Not Invention | Crack | Crack | No Crack | No Crack |
| 9 | Not Invention | Crack | Crack | Crack | No Crack |
| 10 | Not Invention | Crack | No Crack | No Crack | No Crack |

TABLE 4-continued

| | | Bended sample surface cracking | | | |
|---|---|---|---|---|---|
| Sample ID | Invention alloy? | 1.25t | 1.6t | 1.88t | 2.4t |
| 11 | Not Invention | Crack | No Crack | No Crack | No Crack |
| 2024-T3 Specification (AMS4037) | | | | 2.5t | |

By considering both strength and formability, inventive alloy #1 to #4 has very high strength, high formability, and low cost. Non-Inventive Alloy #5 has very low strength due to low Cu content. The other non-inventive alloys #6 to #11 have also high strength and high formability, but high cost because of the Ag addition.

Example 2: Full Scale Plant Trial

Two industrial scale 406 mm (16") thick ingots of the inventive alloys and one of the 2198 alloy were cast by DC (Direct Chill) casting process and processed to 0.05" thickness sheets. The 2198 alloy was used as a baseline alloy. Table 5 gives the chemical compositions of industrial scale ingots of inventive alloys and 2198 alloy.

TABLE 5

| | Alloy Chemical Compositions, wt. % | | | | | | | | |
|---|---|---|---|---|---|---|---|---|---|
| Alloys | Si | Fe | Cu | Mn | Mg | Zn | Zr | Li | Ag |
| Alloy A (Invention) | 0.03 | 0.05 | 3.92 | 0.340 | 0.98 | 0.36 | 0.08 | 1.11 | 0.00 |
| Alloy B (Invention) | 0.03 | 0.05 | 4.02 | 0.345 | 0.99 | 0.36 | 0.09 | 1.11 | 0.00 |
| 2198 (Baseline) | 0.03 | 0.05 | 3.18 | 0.350 | 0.54 | 0.02 | 0.10 | 0.91 | 0.27 |

The ingots were homogenized at temperature from 496 to 538° C. (925 to 1000° F.). The hot rolling temperatures were from 371 to 466° C. (700 to 870° F.). The ingots were hot rolled at multiple passes into 0.06 to 0.20" thickness. Although the cold rolling is optional, all sheets were further cold rolled to 0.05" thickness. The cold rolled sheets were solution heat treated at a temperature range from 493 to 532° C. (920 to 990° F.). The sheets were cold water quenched to room temperature. Although the stretching or cold working is optional, all example sheets were stretched by 2 to 7%. The stretched sheets without artificial aging were used for T3 temper tensile and formability evaluations. The stretched sheets were further aged to T8 temper for strength, fracture, and fatigue performance evaluation. The aging temperature was 166° F. (330° F.) for 24 hours.

The tensile properties of T3 temper sheets along rolling direction (L), long transverse direction (LT) and 45 degree off the rolling direction (L45) are given in Table 6, The invention alloy sheets, Alloy A and Alloy B, have higher strength than existing T3 temper 2198 alloy sheet and also 2024-T3 minimum per AMS4037. The difference of strength in different tensile orientations, L, LT and L45, (i.e. the in-plane anisotropy) is also very low.

TABLE 6

| Alloy | L UTS, ksi | L TYS, ksi | L EL % | LT UTS, ksi | LT TYS, ksi | LT EL % | L45 UTS, ksi | L45 TYS, ksi | L45 EL % |
|---|---|---|---|---|---|---|---|---|---|
| Alloy A | 65.9 | 49.8 | 21.0 | 67.1 | 44.7 | 18.0 | 64.6 | 44.2 | 21.5 |
| Alloy B | 66.9 | 49.1 | 18.5 | 67.6 | 45.6 | 19.0 | 65.4 | 43.9 | 20.5 |
| 2198 | 54.8 | 40.9 | 16.5 | 53.1 | 37.3 | 14.0 | 52.7 | 37.3 | 17.5 |
| 2024-73 (AMS4037) | | | | 63.0 | 42.0 | 15.0 | | | |

Table 7 gives the tensile properties along L, LT, and L45 orientations for the different alloys and aging times at 330° F. The inventive alloy sheets, Alloy A and Alloy B, have much higher strength than existing 2198 alloy sheet in all the testing orientations and aging times.

TABLE 7

| Alloy | Aging Hours at 330 F. | L UTS, ksi | L TYS, ksi | L EL % | LT UTS, ksi | LT TYS, ksi | LT EL % | L45 UTS, ksi | L45 TYS, ksi | L45 EL % |
|---|---|---|---|---|---|---|---|---|---|---|
| Alloy A | 18 | 80.6 | 78.0 | 7.3 | 80.1 | 74.1 | 6.5 | 78.4 | 71.9 | 8.0 |
| | 24 | 80.0 | 77.3 | 7.3 | 79.1 | 71.8 | 9.5 | 78.7 | 71.6 | 8.0 |
| | 32 | 80.8 | 78.5 | 6.3 | 80.1 | 73.8 | 7.8 | 78.5 | 72.3 | 7.8 |
| Alloy B | 18 | 83.9 | 81.9 | 6.5 | 82.8 | 76.5 | 7.0 | 80.9 | 75.2 | 6.5 |
| | 24 | 83.9 | 82.3 | 7.3 | 82.7 | 76.6 | 7.3 | 80.8 | 75.0 | 8.5 |
| | 32 | 84.0 | 82.0 | 6.0 | 82.3 | 76.6 | 6.8 | 81.5 | 75.9 | 7.0 |
| 2198 | 24 | 71.1 | 67.9 | 9.8 | 69.6 | 63.3 | 9.5 | 69.0 | 62.1 | 10.5 |
| | 32 | 70.9 | 67.7 | 11.0 | 70.0 | 64.1 | 8.0 | 69.1 | 62.6 | 10.3 |
| 7075-T62 (AMS4045) | | | | | 78.0 | 68.0 | 9.0 | | | |
| 2024-T8 (AMS-QQ-A/250) | | | | | 67.0 | 58.0 | 5.0 | | | |

7075-T62 aluminum sheet is the typical product for "high strength—medium damage tolerance" aerospace application. Compared with 7075-T62, inventive alloy has much higher strength, especially Yield Strength (TYS).

The formability was evaluated by both standard uniaxial bend and Forming Limit Diagram (FLD) tests.

Figure 2:
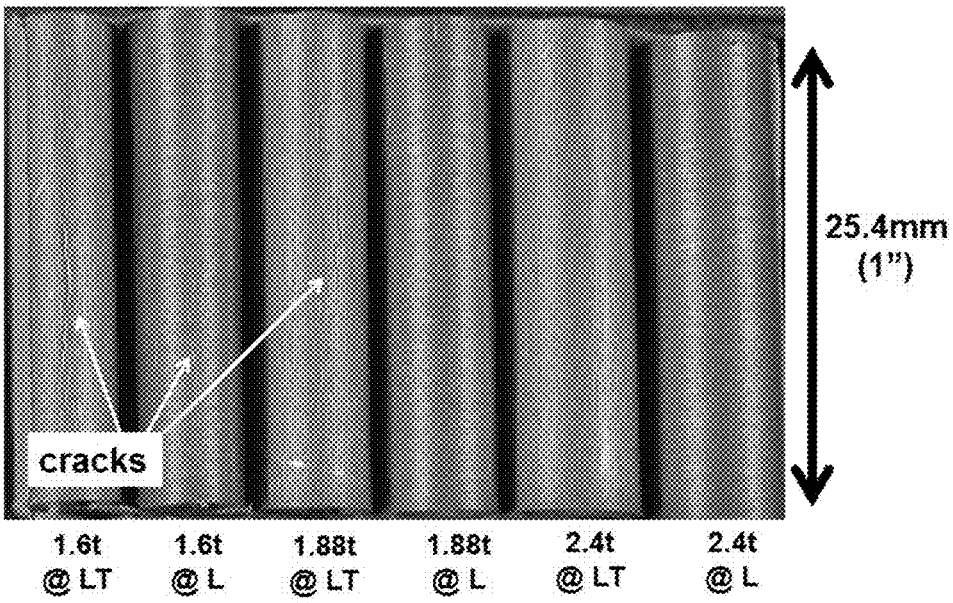
FIG. 2 provides pictures showing the surface cracking conditions of bended of Alloy A T3 temper sheet, an aluminum-lithium alloy of the present invention.

As described above, the bend test was based on ASTM 290-09. As an example, FIG. 2 gives the surface cracking conditions of bended Alloy A T3 temper sheet at different bend ratios and different directions Longitudinal (L) and Long-Transverse (LT). Small cracks can be observed for low bending ratio of 1.6*t, but no cracks are observed at the 1.88*t bending ratio.

Table 8 gives the bending performance of T3 temper sheets for both directions Longitudinal and Long-Transverse, at two different stretching levels after quench (2% and 6%) and various bend ratios. For inventive alloys, a few cracks can be found at bend ratios of 1.6*t to 1.88*t; for the much lower strength AA2198 alloy, no cracks are found at 1.25*t. Alloy A and B have the same bending performance. 2198 alloy has slightly better bending performance compared to inventive alloy, but with much lower strength. Also note with the Ag content in 2198, it is also a much more expensive alloy to produce.

TABLE 8

| Alloy | Temper | Stretching | Test Direction | Bended sample surface cracking 1.25t | 1.6t | 1.88t | 2.4t |
|---|---|---|---|---|---|---|---|
| Alloy A | T3 | 2.0% | L | Crack | Crack | No Crack | No Crack |
| Alloy A | T3 | 2.0% | LT | Crack | Crack | Crack | No Crack |
| Alloy A | T3 | 6.0% | L | Crack | Crack | No Crack | No Crack |
| Alloy A | T3 | 6.0% | LT | Crack | Crack | Crack | No Crack |
| Alloy B | T3 | 2.0% | L | Crack | Crack | No Crack | No Crack |
| Alloy B | T3 | 2.0% | LT | Crack | Crack | Crack | No Crack |
| 2198 | T3 | 2.0% | L | Crack | No Crack | No Crack | No Crack |
| 2198 | T3 | 2.0% | LT | Crack | No Crack | No Crack | No Crack |
| 2198 | T3 | 6.0% | L | Crack | No Crack | No Crack | No Crack |
| 2198 | T3 | 6.0% | LT | Crack | No Crack | No Crack | No Crack |
| 2024-T3 Specification (AMS4037) | | | | | | 2.5 t | |

The inventive alloys have better bending performance than the widely used 2024 T3 sheets, where the minimum bending ratio required by the industry specification AMS 4037 is 2.5*t.

Figure 3:
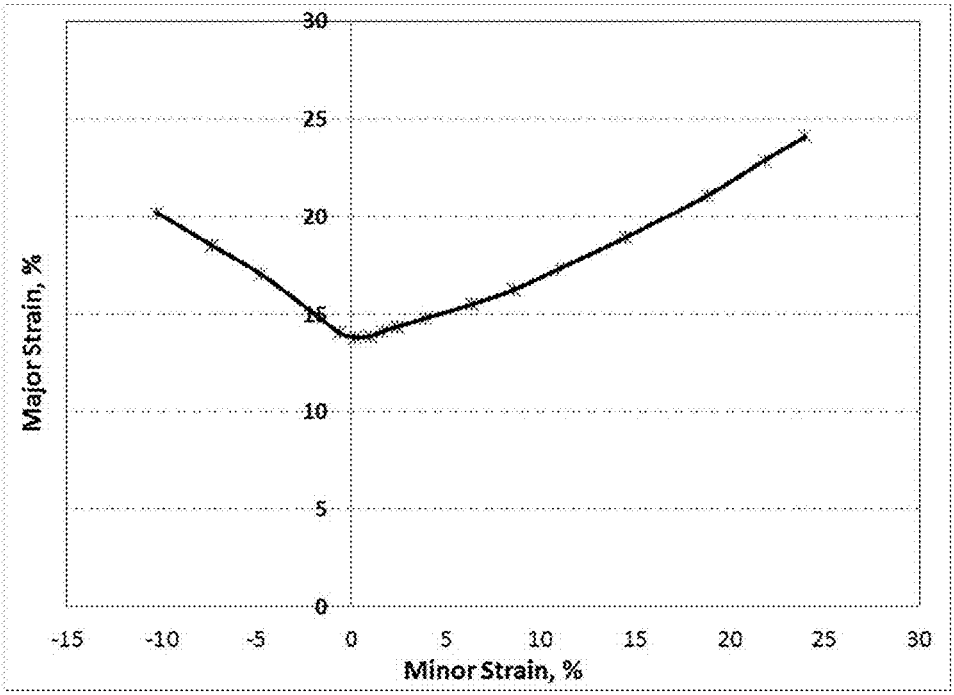
FIG. 3 is a graph showing the Forming Limit Curve (FLC) of T3 temper of Alloy A sheet, an aluminum-lithium alloy of the present invention.

FIG. 3 is a graph that gives the Forming Limit Diagram (FLD) of inventive Alloy A T3 temper sheet. The FLD was evaluated based on ASTM E2218-02 (Reapproved 2008) specification. A Forming Limit Curve (FLC) was generated by the points identified by necking on the samples.

Figure 4:
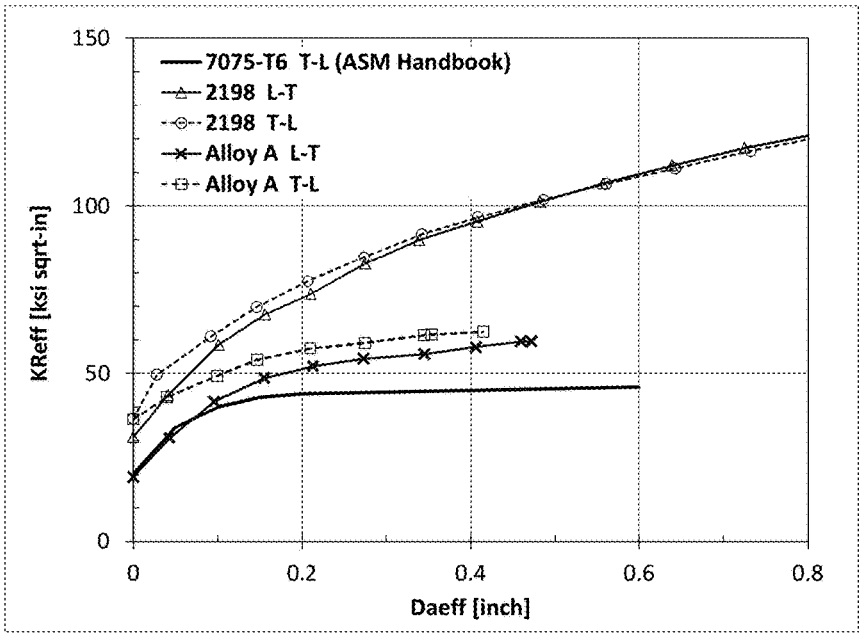
FIG. 4 is a graph showing the effective crack resistance $KR_{eff}$ as a function of the effective crack extension ($Da_{eff}$) of Alloy A in T8 temper (an aluminum-lithium alloy of the present invention), 2198 in T8 temper, and 7075 alloy in T6 temper sheets.

The fracture toughness was evaluated based on ASTM E561-10e2 and ASTM B646-06a. The commonly used 16" wide and 40" long specimen was used for 0.05" thickness sheet center cracked tension fracture toughness testing. FIG. 4 is a graph showing the effective crack resistance $KR_{eff}$ as function of effective crack extension ($Da_{eff}$) of inventive Alloy A and 2198 in T8 temper. The 7075-T6 data from ASM Handbook (ASM Handbook Volume 19: Fatigue and Fracture R. J. Bucci et. al. Page 771-812) was also added in FIG. 4. The inventive alloy in T8 temper sheet has better fracture toughness than 7075-T6, but less than 2198-T8 sheet. This is consistent with the "high strength—medium damage tolerance" target of the inventive alloys, when the AA2198 is a "medium strength—high damage tolerance" alloy.

Figure 5:
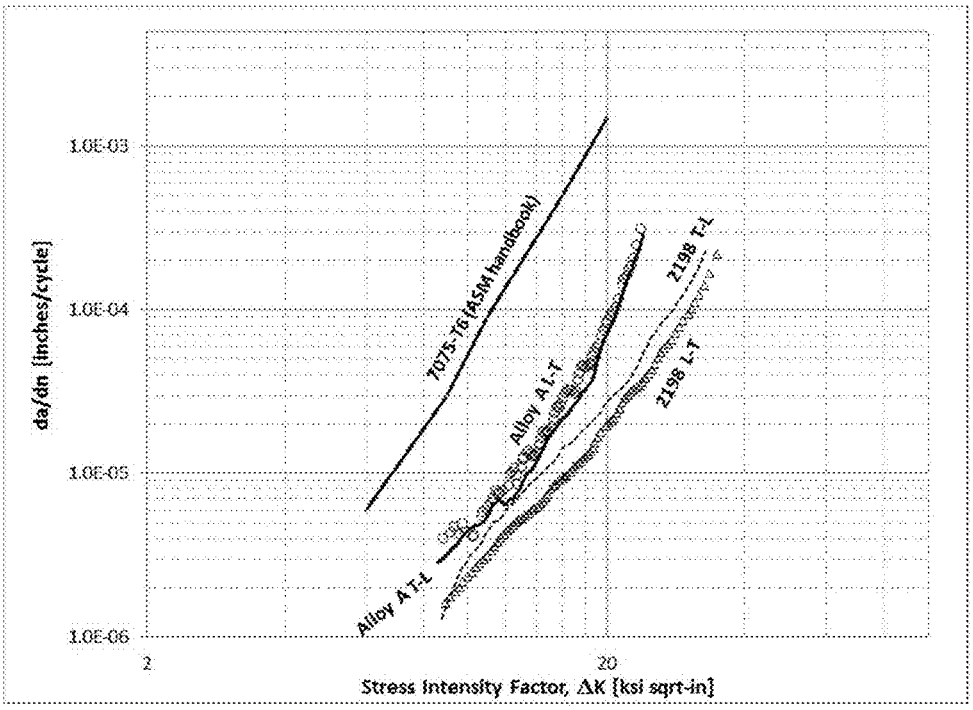
FIG. 5 is a graph showing da/dN as a function of stress intensity factor of Alloy A (an aluminum-lithium alloy of the present invention) and 2198 T8 temper sheets in T-L and L-T orientations.

The Fatigue Crack Growth Rate (FCGR) was evaluated based on ASTM E647-08 (9.1). FIG. 5 is a graph showing the da/dN as a function of stress intensity factor of both inventive Alloy A and 2198 T8 temper sheets in both T-L and L-T orientations. The 2198 and Alloy A testing results in FIG. 5 were based on a stress ratio of 0.1 and a frequency of 10 Hz. The 7075-T6 data from ASM Handbook (ASM Handbook Volume 19: Fatigue and Fracture R. J. Bucci et. al. Page 771-912) was also added in FIG. 5. The inventive alloy has better fatigue crack growth resistance performance than 7075-T6 sheet, but comparable or only slightly worse than 2198 alloy.

The corrosion resistance was evaluated by the MASTMASSIS tests. The MASTMASSIS test is generally considered to be a good representative accelerated corrosion method for Al—Li based alloys.

The MASTMASSIS test was based on ASTM G85-11 Annex-2 under dry-bottom conditions. The sample size was 0.050" thickness×4.0"L×4.0" LT. The temperature of the exposure chamber through the duration of the test was 49±2° C. The T8 temper 2198 and Alloy A were tested at both T/2 (center of thickness) and T/10 (1/10 of thickness from surface) locations. The testing duration times were 24, 48, 96, 168, 336, 504, and 672 hrs.

Figure 6:
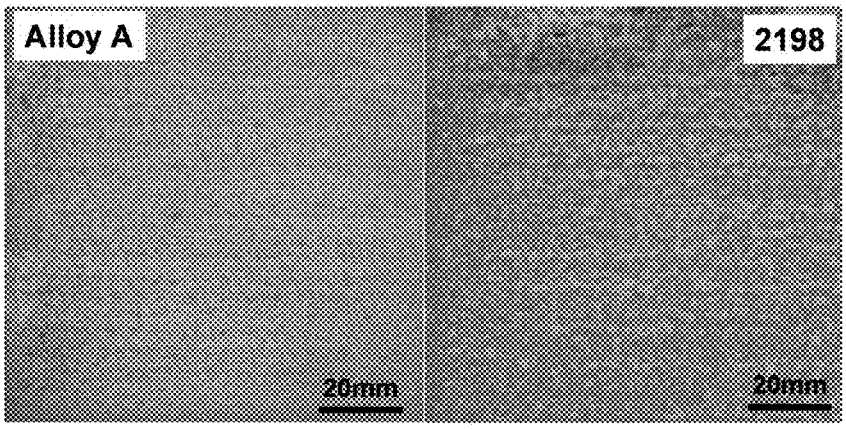
FIG. 6 is a picture showing the typical surface appearances after 672 hours MASTMASSIS testing exposure time for both Alloy A (an aluminum-lithium alloy of the present invention) and 2198 alloy at T/2 location.
Figure 7:
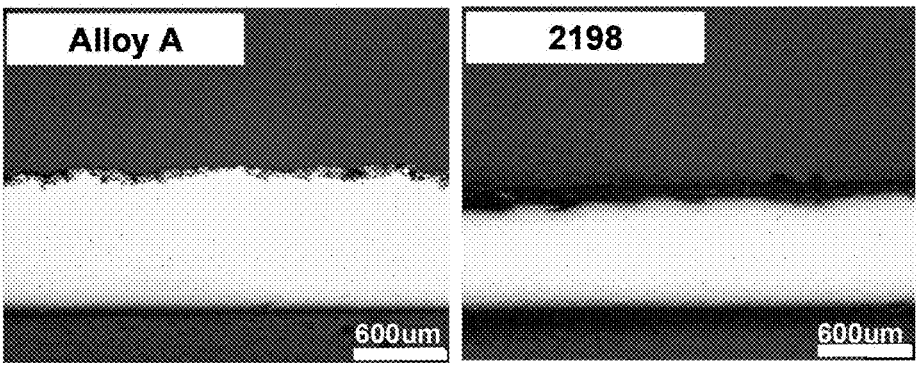
FIG. 7 shows a picture of the microstructure of the samples after 672 hours MASTMASSIS testing exposure time for both Alloy A (an aluminum-lithium alloy of the present invention) and 2198 alloy at T/2 location.

FIG. 6 is a picture of typical surface images after 672 hours MASTMASSIS testing exposure time for both inventive Alloy A and 2198 alloy at T/2 location. Inventive alloy A has pitting rating and 2198 has strong pitting rating. FIG. 7 shows the microstructure of the samples after 672 hours MASTMASSIS testing exposure time for both T8 temper inventive Alloy A and 2198 alloy at T/2 location. No exfoliation features can be observed.

Table 9 summarizes the MASTMASSIS test corrosion ratings for both inventive alloy and 2198 alloy in T8 temper.

TABLE 9

| Stretching | | | MASTMASSIS Exposure Hours | | | | | | |
|---|---|---|---|---|---|---|---|---|---|
| Alloy | % | Location | 24 | 48 | 96 | 168 | 336 | 504 | 672 |
| Alloy A | 2 | T/2 | Pitting | Pitting | Pitting | Pitting | Pitting | Pitting | Pitting |
| | | T/10 | Pitting | Pitting | Pitting | Pitting | Pitting | Pitting | Pitting |
| | 6 | T/2 | Pitting | Pitting | Pitting | Pitting | Pitting | Pitting | Pitting |
| | | T/10 | Pitting | Pitting | Pitting | Pitting | Pitting | Pitting | Pitting |
| 2198 | 2 | T/2 | Pitting | Pitting | Pitting | Pitting | Pitting | Pitting | Pitting |
| | | T/10 | Pitting | Pitting | Pitting | Pitting | Pitting | Pitting | Pitting |
| | 6 | T/2 | Pitting | Pitting | Pitting | Pitting | Pitting | Pitting | Strong Pitting |
| | | T/10 | Pitting | Pitting | Pitting | Pitting | Pitting | Pitting | Strong Pitting |

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth if the appended claims and any and all equivalents thereof.

What is claimed is:

1. A high strength, high formability and low cost aluminum-lithium alloy comprising:

from about 3.6 to about 4.5 wt. % Cu, from about 0.8 to about 1.3 wt. % Li, from about 0.90 to about 1.3 wt. % Mg, less than about 0.1 wt. % Ag, from about 0.03 to about 0.6 wt. % of at least one grain structure control element selected from the group consisting of Zr, Sc, Cr, V, Hf, and other rare earth elements, optionally up to about 0.4 wt. % Zn, optionally up to about 0.4 wt. % Mn, up to about 0.15 wt. % Ti, up to about 0.12 wt. % Si, up to about 0.15 wt. % Fe, up to about 0.15 wt. % of each incidental elements, with the total of these incidental elements not exceeding about 0.35 wt. %, with the balance being aluminum, wherein said aluminum-lithium alloy is a rolled or extruded alloy product having a thickness less than 0.249", and wherein said aluminum-lithium alloy exhibits in a solution heat-treated, quenched, stretched and artificially aged condition a minimum longitudinal yield strength of 71 ksi.

2. The aluminum-lithium alloy of claim 1, wherein the Cu content in the alloy is from about 3.6 to about 4.2 wt. %.

3. The aluminum-lithium alloy of claim 1, wherein the Li content in the alloy is from about 0.9 to about 1.3 wt. %.

4. The aluminum-lithium alloy of claim 1, wherein the Mg content in the alloy is from about 0.90 to about 1.2 wt. %.

5. The aluminum-lithium alloy of claim 1, wherein the grain structure control element selected from the group consisting of Zr, Sc, Cr, V, Hf, and other rare earth elements is at least 0.05 wt. %.

6. The aluminum-lithium alloy of claim 1, wherein the Si content in the alloy is maximum about 0.05 wt. %.

7. The aluminum-lithium alloy of claim 1, wherein the Fe content in the alloy is maximum about 0.08 wt. %.

8. The aluminum-lithium alloy of claim 1, wherein the grain structure control element selected from the group consisting of Zr, Sc, Cr, V, Hf, and other rare earth elements is a maximum of about 0.1 wt. %.

9. The aluminum-lithium alloy of claim 1, wherein the Ag content in the alloy is less than 0.05 wt. %.

10. The aluminum-lithium alloy of claim 1, wherein no Ag is intentionally added to the aluminum alloy.

11. The aluminum-lithium alloy of claim 1, wherein said aluminum-lithium alloy has a maximum thickness of about 0.125".

12. The aluminum-lithium alloy of claim 1, wherein the aluminum-lithium alloy is in the form of a sheet or a coil having a thickness from about 0.01" to 0.249".

13. The aluminum-lithium alloy of claim 12, wherein the aluminum-lithium alloy has a maximum thickness of about 0.125".

14. A rolled product comprising an aluminum-lithium alloy according to claim 1, having a maximum thickness of about 0.249", exhibiting in a solution heat-treated, quenched, stretched and artificially aged condition a minimum longitudinal yield strength of 71 ksi.

15. A rolled product comprising an aluminum-lithium alloy according to claim 1, exhibiting in a solution heat-treated, quenched, stretched and artificially aged condition a minimum longitudinal yield strength of 74 ksi.

16. A rolled product comprising an aluminum-lithium alloy according to claim 1, having a maximum thickness of about 0.125", exhibiting in a solution heat-treated, quenched, stretched and artificially aged condition a minimum longitudinal yield strength of 71 ksi.

17. A rolled product comprising an aluminum-lithium alloy according to claim 1, having a maximum thickness of about 0.125", exhibiting in a solution heat-treated, quenched, stretched and artificially aged condition a minimum longitudinal yield strength of 74 ksi.

18. A rolled product comprising an aluminum-lithium alloy according to claim 1, exhibiting in a solution heat-treated, quenched and stretched condition a minimum bending radius of 1.88*t in longitudinal direction.

19. The aluminum-lithium alloy of claim 1, wherein the Cu content in the alloy is from about 3.6 to about 4.2 wt. %, the Li content in the alloy is from about 0.9 to about 1.3 wt. %, the Mg content in the alloy is from about 0.90 to about 1.2 wt. %, and the Ag content in the alloy is less than 0.05 wt. %.

20. A method of manufacturing a high strength, high formability, low cost aluminum-lithium alloy, the method comprising:

a. casting stock of an ingot of aluminum alloy comprising the aluminum-lithium alloy product of claim 1 producing a cast stock
b. homogenizing the cast stock producing a homogenized cast stock;
c. hot working the homogenized cast stock by one or more methods selected from the group consisting of rolling, extrusion, and forging forming a worked stock;
d. optionally cold rolling the worked stock;
e. solution heat treating (SHT) the optionally cold rolled, worked stock producing a SHT stock;
f. cold water quenching said SHT stock to produce a cold water quenched SHT stock;
g. optionally stretching the cold water quenched SHT stock; and
h. artificially ageing of the cold water quenched, optionally stretched SHT stock.

21. The method of claim 20, wherein said step of homogenizing includes homogenizing at temperatures from 454 to 549° C. (850 to 1020° F.).

22. The method of claim 20, wherein said step of hot working includes hot rolling at a temperature of 343 to 499° C. (650 to 930° F.).

23. The method of claim 20, wherein said step of optionally cold work includes cold reduction at about 20% to 95%.

24. The method of claim 20, wherein said step of optionally stretching includes stretching up to about 15%.

25. The method of claim 20, wherein said step of ageing includes 121 to 205° F. (250 to 400° F.) and the aging time can be in the range of 2 to 60 hours.

26. The method of claim 20, wherein a. said step of homogenizing includes homogenizing at temperatures from 454 to 549° C. (850 to 1020° F.),
b. said step of hot working includes hot rolling at a temperature of 343 to 499° C. (650 to 930° F.)
c. said step of optionally cold work includes cold reduction at about 20% to 95%,
d. said step of solution heat treating includes solution heat treated at temperature range from 454 to 543° C. (850 to 1010° F.),
e. said step of optionally stretching includes stretching at about up to 15%,
f. said step of ageing includes 121 to 205° F. (250 to 400° F.) and the aging time can be in the range of 2 to 60 hours.

27. The method of claim 20, wherein said step of solution heat treating includes solution heat treated at temperature range from 454 to 543° C. (850 to 1010° F.).

* * * * *